United States Patent [19]

Nakazato et al.

[11] Patent Number: 4,459,216

[45] Date of Patent: Jul. 10, 1984

[54] CHEMICAL DISSOLVING SOLUTION FOR METALS

[75] Inventors: Toshihiro Nakazato, Kanagawa; Itaru Ikeya, Shizuoka; Sadao Iida, Hadano; Toshihiko Yamazaki, Odawara; Yutaka Oshida, Matsudo, all of Japan

[73] Assignee: Mitsubishi Gas Chemical Company, Inc., Tokyo, Japan

[21] Appl. No.: 492,421

[22] Filed: May 6, 1983

[30] Foreign Application Priority Data

May 8, 1982 [JP] Japan ..... 57-77257

[51] Int. Cl.[3] ..... C09K 13/06; C23F 1/00

[52] U.S. Cl. ..... 252/79.4; 134/3; 156/664; 156/665; 156/666

[58] Field of Search ..... 252/79.4, 79.2; 156/664, 665, 666; 134/3, 41

[56] References Cited

U.S. PATENT DOCUMENTS

| | | | |
|---|---|---|---|
| 3,407,141 | 10/1968 | Banush et al. | 252/79.4 |
| 3,801,512 | 4/1974 | Solenberger | 252/79.4 X |
| 3,905,907 | 9/1975 | Shiga | 156/664 X |
| 4,130,454 | 12/1978 | Dutkewych et al. | 156/659.1 |
| 4,306,933 | 12/1981 | DaFonte | 252/79.4 X |

FOREIGN PATENT DOCUMENTS

| | | |
|---|---|---|
| 46-5041 | 2/1971 | Japan . |
| 53-32340 | 9/1978 | Japan . |
| 53-33529 | 9/1978 | Japan . |
| 53-33528 | 9/1978 | Japan . |
| 54-40448 | 12/1979 | Japan . |
| 1546524 | 5/1979 | United Kingdom . |

*Primary Examiner*—William A. Powell

*Attorney, Agent, or Firm*—Armstrong, Nikaido, Marmelstein & Kubovcik

[57] ABSTRACT

An aqueous acidic chemical dissolving solution comprising hydrogen peroxide, an inorganic acid and a specific aromatic compound is applicable to etching, pickling and surface treatment of various kinds of metals with a good stabilization effect and a good life, giving a metal surface with good luster.

12 Claims, 1 Drawing Figure

Figure
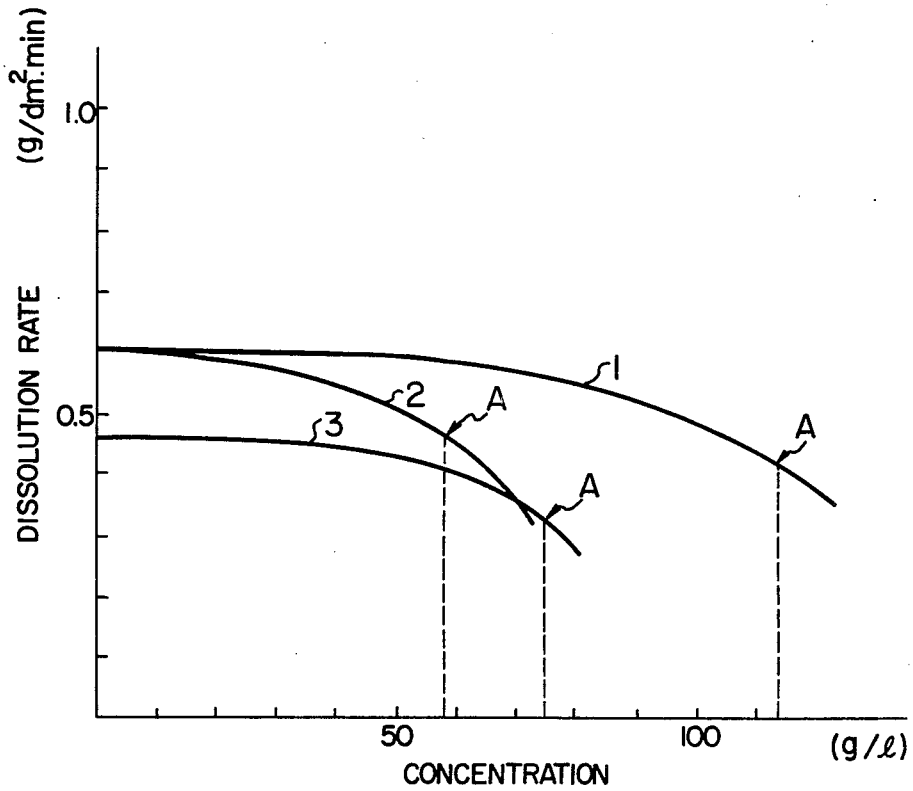

CHEMICAL DISSOLVING SOLUTION FOR METALS

This invention relates to a chemical dissolving solution for use in chemical polishing, scale removal, etching or pickling of metals, and more particularly to an aqueous acidic chemical dissolving solution for metals, which comprises hydrogen peroxide, an inorganic acid and an aromatic compound having at least one amino group directly bonded to the benzene nucleus.

The present chemical dissolving solution is applicable to metals such as copper, iron, tin, nickel, cobalt, zinc, chromium, titanium, aluminum and their alloys. Particularly preferable alloys are copper alloys such as brass, phosphor bronze, cupro-nickel, etc. and iron alloys such as iron-nickel, iron-nickel-cobalt, iron-nickel-chromium, etc. These metals have various uses and chemical treatment of the metals have been so far carried out in view of their specific uses and objects with chemical dissolving solutions based on mixed acids such as nitric acid-sulfuric acid, nitric acid-hydrochloric acid, nitric acid-hydrofluoric acid, nitric acid-phosphoric acid, and nitric acid-acetic acid. These chemical dissolving solutions contain nitric acid as the main component and thus generate toxic $NO_x$ gases with adverse effects upon environments.

In place of the mixed acids containing nitric acid as the main component, chemical dissolving solutions comprising hydrogen peroxide and an inorganic acid such as sulfuric acid, hydrofluoric acid, hydrochloric acid or phosphoric acid or sulfamic acid have been utilized for these purposes. However, in the chemical dissolving solutions containing hydrogen peroxide and an inorganic acid as the main components, dissolved metal ions due to metal treatment promote decomposition of hydrogen peroxide in the solution, and thus various stabilizers have been added to the solutions to suppress the decomposition of hydrogen peroxide. The known stabilizers include phenacetin, sulfathiazole, aliphatic alcohols, aliphatic amines, protein, benzoic acid, phenols, arylsulfonic acids, etc.

For example, Japanese Patent Publication No. 53-32340 discloses a chemical polishing solution for copper and copper alloys, which comprises 0.5–30% (W/W) of sulfuric acid, 5–60% (W/W) of hydrogen peroxide, at least 0.005% (W/W) of phosphoric acid, and at least 0.1% (W/W) of amine, where primary, secondary or tertiary aliphatic amines, alcyclic amines such as cyclohexylamine, hexamethylenediamine, benzamide, isatin, benzotriazole, imidazole, acetanilide, and diphenylamine are used as the amine.

Japanese Patent Publication No. 53-33529 discloses a pickling solution comprising 30–500 g/l of sulfuric acid, 0.1–50 g/l of hydrogen peroxide, and 5–100 cc/l of n-octylamine, where only n-octylamine is indicated as effective.

Japanese Patent Publication No. 53-33528 discloses a pickling solution for copper and copper alloy which comprises 10–500 g/l of sulfuric acid, 0.1–50 g/l of hydrogen peroxide, 0.001 g/l of at least one of aliphatic alcohol, ether, carboxylic acid, amine, imine, ester and acid amide, and 0.1 g/l of glue or gelatin, where alkylamines such as from primary amines to quaternary ammonium salts, polyamines such as hexamethylenediamine are shown as the amine and the imine, and also an aromatic amine such as anilin is indicated as not effective.

U.S. Pat. No. 3,407,141 discloses an etching solution comprising an acid, hydrogen peroxide, and at least one of phenylurea, diphenylurea, benzoic acid and hydroxybenzoic acid, where phenacetin, sulfathiazole and silver ions are added thereto.

British Patent No. 1546524 discloses an etching solution comprising an acid, hydrogen peroxide and arylsulfuric acid as a stabilizer.

However, the effect of these stabilizers considerably depends upon the species of metals to be treated, and these stabilizers have a narrow allowance for selection, and their stabilization effects and dissolving capacity are not satisfactory. Furthermore, these stabilizers have no properties to substantially improve the luster of metal surfaces after chemical dissolution treatment or prolong the life of a chemical dissolving solution. Thus, it is necessary to add a brightener, etc. thereto.

The term "life of a chemical dissolving solution" means a state of the solution still maintaining the dissolving capacity for metals. A large amount of metal is dissolved in said solution due to treatment for metal, and concentration of the metal ion reaches a saturations, resulting in precipitation of metal salts. No good luster of its surface is obtained or the dissolving rate is remarkably decreased, which will be hereinafter called "life is lost" or "an ageing point".

Under these circumstances, the present inventors have made an extensive study of an additive having a satisfactory stablizing effect upon a wide range of metals and being also capable of improving the luster of treated metal surfaces, and have found that the specific kind of aromatic compounds have a remarkable effect.

An object of the present invention is to provide a chemical dissolving solution having a good dissolving capacity for various kinds of metal, a good stability and a long life and being capable of producing a lustrous metal surface.

Another object of the present invention is to provide an additive having a satusfactory stabilizing effect when added even in a small amount and an effect of improving luster of metal surfaces after the chemical dissolution treatment, and also an effect of considerably prolonging the life of a chemical dissolving solution.

Further object of the present invention is to provide an additive having an effect of reducing COD and BOD in a waste chemical dissolving solution, because the amount of the additive for use in the present invention is smaller than that of the stabilizer so far used.

The present invention provides an aqueous acidic chemical dissolving solution for metals, which comprises hydrogen peroxide, an inorganic acid and at least one aromatic compound having at least one amino group directly bonded to the benzene nucleus, represented by the following general formula:

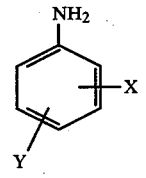

wherein X and Y represent hydrogen atom, hydroxyl group, nitro group, amino group, carboxyl group, and lower alkyl group of $C_1$–$C_4$.

The additive for use in the present invention is an aromatic compound represented by said general formula and includes, for example aniline, aminophenol, diaminobenzene, aminobenzoic acid, toluidine, nitroaniline, aminosalicylic acid, etc., among which aminophenol and aminobenzoic acid are particularly preperable because of their distinguished effects of improving the luster and prolonging the life besides their good stabilization effect.

The additive can be used in an amount up to the solution solubility, but generally in an amount of 0.01 g/l–100 g/l, preferably 0.1 g/l–10 g/l, from the operating and commercial viewpoints.

Hydrogen peroxide can be used in the usual amount so far used as such and is not particularly limited in the present invention, but it is used in a range of 1 g/l to 350 g/l from the operating and commercial viewpoints.

The inorganic acid for use in the present invention is an inorganic acid so far used in the usual chemical treating solution and includes sulfuric acid, hydrochloric acid, phosphoric acid, hydrofluoric acid, nitric acid, sulfamic acid and their acidic salts such as sodium phosphate, potassium phosphate, ammonium hydrogen fluoride, etc. At least one of these inorganic acids and acidic salts is used in a range of 1 g/l–300 g/l from the operating and commercial viewpoints.

The present aqueous acidic chemical dissolving solution includes an aqueous acidic solution containing 5 g/l–100 g/l of hydrogen peroxide and 100 g/l–300 g/l of an inorganic acid, and at least one aromatic compound as defined above where the inorganic acid contains at least 50 g/l of sulfuric acid as the essential component, and this type of chemical dissolving solution is suitable for etching or pickling of copper or copper alloy.

The present aqueous acidic chemical dissolving solution also includes an aqueous acidic solution containing 50 g/l–300 g/l of hydrogen peroxide, 1 g/l–100 g/l of an inorganic acid and at least one aromatic compound as defined above, where the inorganic acid contains at least 0.5 g/l of sulfuric acid as the essential component. This type of chemical dissolving solution is suitable for polishing copper or copper alloy.

The present aqueous acidic chemical dissolving solution also includes an aqueous acidic solution containing 30 g/l–300 g/l of hydrogen peroxide, 10 g/l–200 g/l of an inorganic acid and at least aromatic compound as defined above, where the inorganic acid contains at least 5 g/l of hydrofluoric acid or its acidic salt as the essential component. This type of chemical dissolving solution is suitable for treating iron or iron alloys.

In said three types of aqueous acidic chemical dissolving solutions, the aromatic compound as defined above can be used in said amount, i.e. 0.01 g/l–100 g/l, and balance of inorganic acid other than the essential component can be selected from other acids or their acidic salts described above.

The present aqueous acidic chemical dissolving solution can be used at a temperature of 10°–80° C., preferably 20°–60° C. for a treating time of 5 sec.–30 min., preferably 10 sec.–10 min. by dipping or spraying or according to a rotating barrel method, and the present invention will not be limited to any of these treating procedures.

The present invention will be described in detail below, referring to Examples and Drawing.

The single FIGURE shows relationship between the dissolving rate of a chemical dissolving solution and a metal concentration of the treating solution, where curve 1 shows an example of the present chemical dissolving solution, curve 2 is a comparative example using methanol as an additives, curve 3 is another comparative example using p-phenolsulfonic acid as an additive, and points A show ageing points of the respective solutions.

Example 1

In chemical dissolving solutions containing 100 g/l of hydrogen peroxide, 10 g/l of sulfuric acid and one of additives shown in Table 1 at the concentration given in Table 1, brass pieces (60% Cu+40% Zn) were dissolved, and the solutions were left standing in a thermostat tank at 50° C. for 20 hours to determine percentage of decomposed hydrogen peroxide. The chemical dissolving solutions had a copper concentration of 6 g/l and a zinc concentration of 4 g/l.

TABLE 1

| | Additive | | Percentage of decomposed $H_2O_2$ (%) |
|---|---|---|---|
| No. | Compound | Concentration (g/l) | |
| 1 | aniline | 1 | 10 |
| 2 | o-aminophenol | 1 | 9 |
| 3 | diaminobenzene | 1 | 8 |
| 4 | o-aminobenzoic acid | 1 | 6 |
| 5 | toluidine | 1 | 5 |
| 6 | olnitroaniline | 1 | 6 |
| 7 | 3-aminosalicylic acid | 1 | 9 |
| Comp. Ex. 1 | — | — | 100 |
| Comp. Ex. 2 | methanol | 1 | 11 |
| Comp. Ex. 3 | tributylamine | 1 | 15 |

EXAMPLE 2

In chemical dissolving solutions containing 30 g/l of hydrogen peroxide, 150 g/l of sulfuric acid, 10 g/l of hydrofluoric acid and one of additives shown in Table 2 at the concentration given in Table 2, copper alloy pieces (88% Cu+9% Ni+3% Sn; CAC made by Kobe Seiko K.K., Japan) were dissolved, and the solutions were left standing in a thermostat tank at 50° C. for 60 hours to determine percentage of decomposed hydrogen peroxide. The chemical dissolving solutions had a copper concentration of 8 g/l, a nickel concentration of 0.8 g/l and a tin concentration of 0.3 g/l, respectively.

TABLE 2

| | Additive | | Percentage of decomposed $H_2O_2$ (%) |
|---|---|---|---|
| No. | Compound | Concentration (g/l) | |
| 8 | o-aminobenzoic acid | 0.1 | 10 |
| 9 | o-aminobenzoic acid | 1 | 7 |
| 10 | o-aminobenzoic | 2 | 8 |
| Comp. Ex. 4 | — | — | 100 |
| Comp. Ex. 5 | methanol | 1 | 12 |
| Comp. Ex. 6 | tributylamine | 1 | 17 |

EXAMPLE 3

In chemical dissolving solutions containing 100 g/l of hydrogen peroxide, 10 g/l of sulfuric acid, 20 g/l of ammonium hydrofluoride and one of additives shown in Table 3 at the concentration given in Table 3, Kovar pieces (55% Fe+29% Ni+16% Co) were dissolved, and the solutions were left standing in a thermostat tank at 50° C. for 20 hours to determine percentage of decomposed hydrogen peroxide. Each chemical dissolving solution had an iron concentration of 4 g/l, a nickel concentration of 2.1 g/l and a cobalt concentration of 1.2 g/l.

TABLE 3

| No. | Additive Compound | Additive Concentration (g/l) | Percentage of decomposed $H_2O_2$ (%) |
|---|---|---|---|
| 11 | o-aminophenol | 1 | 17 |
| 12 | o-aminobenzoic acid | 1 | 20 |
| 13 | 3-amino-salicylic acid | 1 | 22 |
| 14 | o-toluidine | 1 | 19 |
| Comp. Ex. 7 | — | — | 75 |
| Comp. Ex. 8 | methanol | 1 | 73 |
| Comp. Ex. 9 | tributylamine | 1 | 74 |
| Comp. Ex. 10 | metanilic acid | 1 | 45 |
| Comp. Ex. 11 | benzoic acid | 1 | 51 |

EXAMPLE 4

The same copper alloy pieces as used in Example 2 were treated in the same chemical dissolving solutions as used in Example 2 at 50° C. for 30 seconds, washed with water and dried to determine the luster of metal surfaces. The results are shown in Table 4. The luster was determined according to JIS Z-8741.

TABLE 4

| No. | Additive Compound | Additive Concentration (g/l) | Luster |
|---|---|---|---|
| 15 | o-aminobenzoic acid | 0.1 | 234 |
| 16 | o-aminobenzoic acid | 1.0 | 272 |
| 17 | o-aminobenzoic acid | 2.0 | 304 |
| Comp. Ex. 12 | p-phenol-sulfonic acid | 1 | 75 |
| Comp. Ex. 13 | p-phenol-sulfonic acid | 5 | 43 |
| Comp. Ex. 14 | p-phenol-sulfonic acid | 10 | 21 |
| Comp. Ex. 15 | methanol | 1.0 | 194 |
| Comp. Ex. 16 | tributylamine | 1.0 | 188 |
| Comp. Ex. 17 | — | — | 79 |
| Comp. Ex. 18 | methanilic acid | 1.0 | 127 |
| Comp. Ex. 19 | benzoic acid | 1.0 | 144 |

EXAMPLE 5

The same copper-nickel-tin alloy piece as in Example 2 was dissolved in a chemical dissolving solution containing 30 g/l of hydrogen peroxide, 100 g/l of sulfuric acid, 10 g/l of hydrofluoric acid and 1 g/l of o-aminobenzoic acid to determine the life (ageing point) of the solution. Concentrations of hydrogen peroxide, sulfuric acid and O-aminobenzoic acid were decreased in the solution with dissolution of the piece, and their consumptions were compensated by appropriately adding these components to the solution to keep the concentrations constant. In FIGURE, curve 1 shows the present chemical dissolving solution of said composition, curve 2 a comparative chemical dissolving solution containing 20 g/l of methanol in place of o-aminobenzoic acid, and curve 3 a comparative chemical dissolving solution containing 10 g/l of p-phenolsulfonic acid in place of o-aminobenzoic acid, and points A ageing points (metal deposition).

It is seen from FIGURE that the present chemical dissolving solution had a metal concentration of 114 g/l in terms of copper at the ageing point, the comparative solution containing methanol as the additive had that of 57 g/l and the comparative solution containing p-phenolsulfonic acid had that of 75 g/l.

What is claimed is:

1. An aqueous acidic chemical dissolving solution for metals, which comprises hydrogen peroxide, an inorganic acid and at least one aromatic compound having at least one amino group directly bonded to the benzene nucleus represented by the general formula:

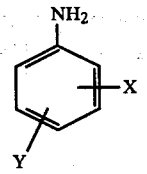

wherein X and Y are hydrogen atom, hydroxyl group, nitro group, amino group, carboxyl group and lower alkyl group of $C_1$–$C_4$.

2. The aqueous acidic chemical dissolving solution according to claim 1 wherein the aromatic compound is aniline aminophenol, diaminobenzene, aminobenzoic acid, toluidine, nitroaniline or aminosalicylic acid.

3. The aqueous acidic chemical dissolving solution according to claim 2, wherein the aromatic compound is aminophenol or aminobenzoic acid.

4. The aqueous acidic chemical dissolving solution according to claim 1 wherein the aromatic compound is in an amount of 0.01 g/l–100 g/l.

5. The aqueous acidic chemical dissolving solution according to claim 1, wherein the hydrogen peroxide is in an amount of 1 g/l–350 g/l.

6. The aqueous acidic chemical dissolving solution according to claim 1, wherein the inorganic acid is in an amount of 1 g/l–300 g/l.

7. An aqueous acidic chemical dissolving solution for etching or pickling copper or copper alloy, which comprises 5 g/l–100 g/l of hydrogen peroxide, 100 g/l–300 g/l of an inorganic acid containing at least 50 g/l of sulfuric acid as the essential component, and at least one aromatic compound having at least one amino group directly bonded to the benzene nucleus represented by the general formula:

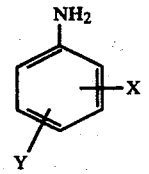

where X and Y are hydrogen atom, hydroxyl group, nitro group, amino group, carboxyl group, and lower alkyl group of $C_1$–$C_4$.

8. An aqueous acidic chemical dissolving solution for polishing copper or copper alloy, which comprises 50 g/l–300 g/l of hydrogen peroxide, 1 g/l–100 g/l of an inorganic acid containing at least 0.5 g/l of sulfuric acid as the essential component, and at least one aromatic compound having at least one amino group directly bonded at the benzene nucleus represented by the general formula:

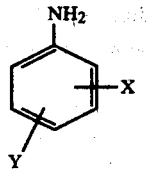

wherein X and Y are hydrogen atom, hydroxyl group, nitro group, amino group, carboxyl group, and lower alkyl group of $C_1$–$C_4$.

9. An aqueous acidic chemical dissolving solution for treating iron or iron alloy, which comprises 30 g/l–300 g/l of hydrogen peroxide, 10 g/l–200 g/l of an inorganic acid containing at least 5 g/l of hydrofluoric acid or its acidic salt as the essential component, and at least one aromatic compound having at least one amino group directly bonded to the benzene nucleus represented by the general formula:

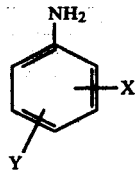

wherein X and Y are hydrogen atom, hydroxyl group, nitro group, amino group, carboxyl group, and lower alkyl group of $C_1$–$C_4$.

10. The aqueous acidic chemical dissolving solution according to claim 7, 8 or 9, wherein the aromatic amine compound is in an amount of 0.01 g/l–100 g/l.

11. The aqueous acidic chemical dissolving solution according to claim 7, 8 or 9, wherein the aromatic compound is aniline aminophenol; diaminobenzene, aminobenzoic acid, toluidine, nitroaniline or aminosalicylic acid.

12. The aqueous acidic chemical dissolving solution according to claim 11, wherein the aromatic compound is aminophenol or aminobenzoic acid.

* * * * *